United States Patent [19]

Webster

[11] Patent Number: 4,597,792

[45] Date of Patent: Jul. 1, 1986

[54] ALUMINUM-BASED COMPOSITE PRODUCT OF HIGH STRENGTH AND TOUGHNESS

[75] Inventor: Donald Webster, Saratoga, Calif.

[73] Assignee: Kaiser Aluminum & Chemical Corporation, Oakland, Calif.

[21] Appl. No.: 742,830

[22] Filed: Jun. 10, 1985

[51] Int. Cl.[4] ..... B22F 3/00

[52] U.S. Cl. ..... 75/249; 148/39; 148/405; 419/23; 419/30; 419/66; 420/528; 420/529; 420/533; 420/540; 420/590; 428/614

[58] Field of Search ..... 420/528, 529, 533, 540, 420/590; 148/405, 39; 75/249; 428/614; 419/23, 30, 66

[56] References Cited

U.S. PATENT DOCUMENTS

| | | | |
|---|---|---|---|
| 3,816,080 | 6/1974 | Bomford et al. | 75/249 |
| 4,053,011 | 10/1977 | Riewald et al. | 420/528 |
| 4,259,112 | 3/1981 | Dolowy et al. | 419/60 |
| 4,444,603 | 4/1984 | Yamatsuta et al. | 428/614 |
| 4,450,207 | 5/1984 | Donomoto et al. | 428/614 |
| 4,452,865 | 6/1984 | Yamatsuta et al. | 428/614 |
| 4,457,979 | 7/1984 | Donomoto et al. | 428/614 |

*Primary Examiner*—Stephen J. Lechert, Jr.
*Attorney, Agent, or Firm*—Andrew E. Barlay

[57] ABSTRACT

High strength and high toughness are combined in an aluminum-based metallic product by dispersing particles of an aluminum-based metal having a toughness of at least about 20 foot-pounds through a matrix of aluminum-based metal having a yield strength of at least about 30 ksi.

26 Claims, 13 Drawing Figures

ALUMINUM-BASED COMPOSITE PRODUCT OF HIGH STRENGTH AND TOUGHNESS

BACKGROUND OF THE INVENTION

This invention relates to high strength aluminum products, and particularly to methods for increasing the toughness of such products without substantial loss of strength.

High strength aluminum alloys and composites are required in certain applications, notably the aircraft industry where the combination of high strength, high stiffness and low density is particularly important. High strength is generally achieved in aluminum alloys by combinations of copper, zinc and magnesium, and high stiffness is generally achieved by metal matrix composites such as those formed by the addition of silicon carbide, boron carbide or aluminum oxide particles to an aluminum matrix. Recently, aluminum-lithium alloys containing 2.0–2.8% lithium by weight have been developed. These alloys possess a lower density and higher elastic modulus than conventional non-lithium-containing alloys.

The preparation and properties of aluminum-based alloys containing lithium are widely disclosed, notably in J. Stone & Company, British Pat. No. 787,665 (Dec. 11, 1957); Ger. Offen. No. 2,305,248 (National Research Institute for Metals, Tokyo, Jan. 24, 1974); Raclot, U.S. Pat. No. 3,343,948 (Sept. 26, 1967); and Peel et al., British Pat. No. 2,115,836 (Sept. 14, 1983). Powder metallury techniques involving the blending of powdered constituents have been disclosed for a variety of purposes, notably by Fujitsu, Ltd., Japanese Pat. No. 53-75107 (1976); Giorgi et al., U.S. Pat. No. 3,713,898 (Jan. 30, 1973); and Reen, U.S. Pat. No. 3,713,817 (Jan. 30, 1973).

It is also well known that alloys can be made by mixing elemental powders and heating the mixture to a temperature high enough to cause diffusion to take place and form an alloy of uniform composition. See *The Physics of Powder Metallurgy,* W. E. Kingston, ed., p. 372, McGraw Hill, New York (1951); and C. G. Goetzel, *Treatise on Powder Metallurgy,* vol. 11, p. 492, Interscience Publishers Inc., New York (1950). Because of the difficulties inherent in obtaining homogeneity, however, the usual practice in aluminum and other alloy systems is to form an alloy powder directly from a prealloyed melt.

Unfortunately, high strength aluminum materials are frequently characterized by low toughness, as evidenced by impact tests on notched specimens (e.g., Charpy tests) and by fracture toughness tests on fatigue precracked specimens where the critical stress intensity factors are determined.

SUMMARY OF THE INVENTION

It has now been discovered that high strength and high toughness can be achieved simultaneously in a single aluminum-based metallic product by dispersing particles of a high toughness aluminum-based metal through a matrix comprised of a high strength aluminum-based metal. The dispersion is most conveniently achieved by powder metallurgy techniques. In some cases, the result is a compromise between strength and toughness. The overall result, however, is a combination of strength and toughness which is a substantial improvement over prior art composites and alloys.

DETAILED DESCRIPTION OF THE INVENTION AND PREFERRED EMBODIMENTS

Figure 1:
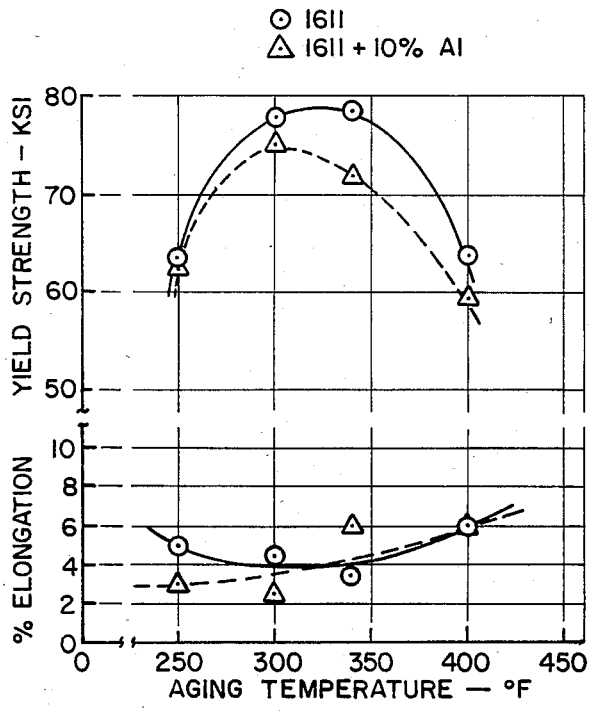
FIG. 1 is a plot of longitudinal tensile properties as a function of aging temperature for edge samples taken from one embodiment of the present invention.

The present invention is applicable to high strength aluminum-based metallic materials of a wide range of composition, including both alloys and high strength composites having a yield strength of at least about 30 ksi (thousand pounds per square inch), preferably at least about 50 ksi, when heat treated to the highest level. This includes such alloys as those containing lithium, copper, magnesium or zinc as the primary alloying element, notably alloys of the 2000, 5000, 7000, and 8000 Aluminum Association series. Examples are the alloys 2014, 2018, 2024, 2025, 2090, 2218, 2618, 7001, 7039, 7072, 7075, 7079, 7178 and 8090. The term "primary alloying element" is used herein to designate any element which amounts to about 1% or more by weight of the alloy, preferably 2% or more.

High strength composites to which the present invention is applicable include a wide range of products wherein aluminum matrices are reinforced with particles, whiskers or fibers of various materials having a high strength or modulus. Examples of the reinforcing phase include boron fibers, $B_4C$-coated boron, SiC-coated boron, $B_4C$ whiskers and particles, SiC whiskers and particles, carbon or graphite fibers, fused silica, alumina, steel, beryllium, tungsten and titanium. The alloys are generally preferred.

The high toughness component of the present invention may be an aluminum-based alloy or composite with an impact toughness of at least about 20 foot-pounds, preferably at least about 50 foot-pounds, or aluminum itself. The term "impact toughness" as used herein designates a value determined by conventional impact techniques, notably the Charpy test technique, a standard procedure established by the American Society for Testing and Materials. Straight aluminum having a maximum impurity level of about 0.5% by weight is preferred. Commercially pure aluminum will generally suffice.

The composite of the present invention may be formed by blending particles of the two components in the desired proportion. The particle size is not critical and may vary over a wide range. In most applications, particles ranging in diameter from about 10 to about 1,000 microns, preferably from about 50 to about 500 microns, or having a volume of about 0.0001 to about 0.01 cubic centimeters each, will provide the best results. It is preferred that the particles of both components have approximately the same size range.

The relative amounts of the components may also vary widely, depending upon the composition of each component and upon the desired properties of the ultimate product. Composites containing from about 2% to about 40% by weight of the high toughness component, preferably from about 5% to about 25% by weight, will generally provide the best results.

The particles themselves may be formed according to conventional techniques, including pulverization, ribbon and splat techniques. Once the powders are formed and sized and appropriate amounts selected, blending is achieved by conventional means.

The blended powders are then consolidated, again by conventional means, to form a billet which can be further processed into the ultimate product. Consolidation may be achieved by unidirectional compaction (including canister techniques), isostatic compaction (both cold and hot), rolling, forging, sintering, or other known methods. Consolidation preferably includes compaction to at least about 85% full density, more preferably at least about 95%. It is particularly preferred that the consolidation and compaction processing steps include the removal of substantially all bound water from the surface of the particles prior to the achievement of full density. This is generally achieved by purging the particle mixture with an inert gas and/or degassing the particles either prior to consolidation or after partial compaction, involving the use of reduced pressure and elevated temperature, preferably not exceeding about 1100° F. (593° C.).

In many cases, the increase in toughness will be accompanied by a loss in strength. In general, the former will more than compensate for the latter, resulting in a product which is improved in overall properties.

The following examples are offered for purposes of illustration, and are intended neither to define nor limit the invention in any manner.

EXAMPLE 1

A composite product was prepared as follows.

A powdered aluminum-lithium alloy containing 2.41% Li, 1.21% Cu, 0.73% Mg and 0.11% Zr (designated herein as 1611) was prepared by a conventional powder metallurgy technique, involving melting and combining the component metals at 1700° F. (927° C.) and atomizing the melt in an inert gas. The resulting particles were sized to −100 mesh (U.S. Sieve Series).

The particles were then blended for 2 hours at room temperature in a rotating V-shaped blender with similarly sized particles of commercially pure aluminum (minimum purity 99.5%), the latter comprising 10% of the total mixture. The mixture was then heated to 900° F. (482° C.), degassed and consolidated by compaction to full density in a canister. The billet was then removed from the canister and extruded at 850° F. (454° C.) at a 29-to-1 ratio, followed by solution heat treatment, stretching in the direction of extrusion to a 5% length increase and aging for 16–100 hours. Different samples were aged at different temperatures.

Tensile properties and impact toughness values were then measured on specimens from the samples as well as samples prepared in the identical manner but without the inclusion of the pure aluminum powder. The tensile tests were performed on round specimens 0.25 inch (0.64 cm) in diameter with a gage length of 1.0 inch (2.54 cm), taken from the extrusion edge of the sample, using standard ASTM testing procedures. Longitudinal tests were performed on both center and edge samples, the latter representing the short transverse edges of the extrusion.

Figure 2:
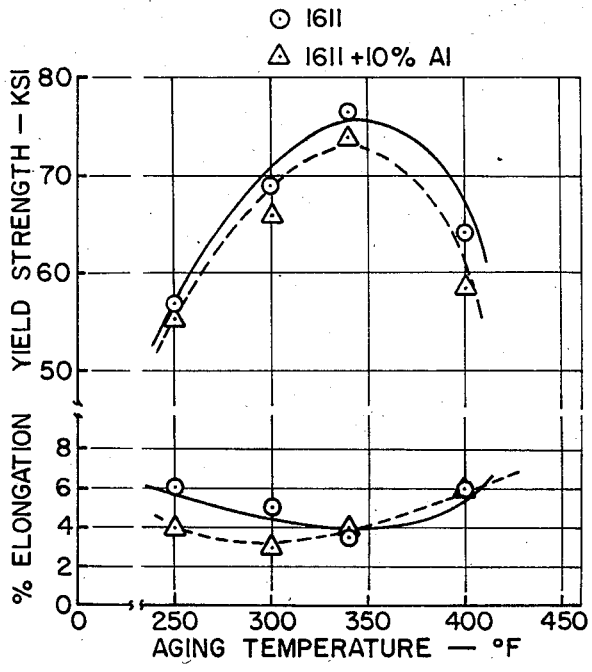
FIG. 2 is a plot similar to FIG. 1, relating however to center samples.

Table 1.1 below lists yield strengths and elongations measured in the longitudinal direction for the various aging temperatures, most entries indicating several trials. An average value for each aging temperature is shown graphically in FIG. 1 (edge results) and FIG. 2 (center results), where the 300° F. values are for 16 h aging time.

TABLE 1.1

LONGITUDINAL TENSILE PROPERTIES

| Aging Temp. (°F.) | Aging Time (h) | Location | 0.2 Yield Strength* (ksi) 1611 | 0.2 Yield Strength* (ksi) 1611 + 10% Al | Elongation (%) 1611 | Elongation (%) 1611 + 10% Al |
|---|---|---|---|---|---|---|
| 250 | 16 | edge | 63.2 | 62.2 | 5 | 2 |
| | | edge | 63.9 | 62.6 | 5 | 4 |
| | | center | 56.9 | 55.3 | 6 | 4 |
| 300 | 16 | edge | 78.0 | 75.4 | 4 | 2 |
| | | edge | 77.8 | 75.0 | 5 | 3 |
| | | center | 69.1 | 65.9 | 5 | 3 |
| 300 | 40 | edge | 84.0 | 81.0 | 4 | 4 |
| | | edge | 85.7 | 80.4 | 3 | 4 |
| | | center | 78.2 | 72.6 | 3 | 4 |
| | | | 77.9 | 70.2 | 4 | 5 |
| 340 | 100 | edge | 78.3 | 73.7 | 3 | 6 |
| | | edge | 79.2 | 70.5 | 4 | 6 |
| | | center | 76.6 | 73.8 | 3 | 4 |
| 400 | 16 | edge | 64.7 | 59.4 | 6 | 6 |
| | | edge | 63.2 | 59.5 | 6 | 6 |
| | | center | 64.2 | 58.4 | 6 | 6 |

*0.2 Yield Strength = stress required to cause permanent 0.2% offset

It is evident from these figures that some loss in strength resulted from incorporating the pure aluminum, while the elongation on the average was approximately unchanged.

Figure 3:
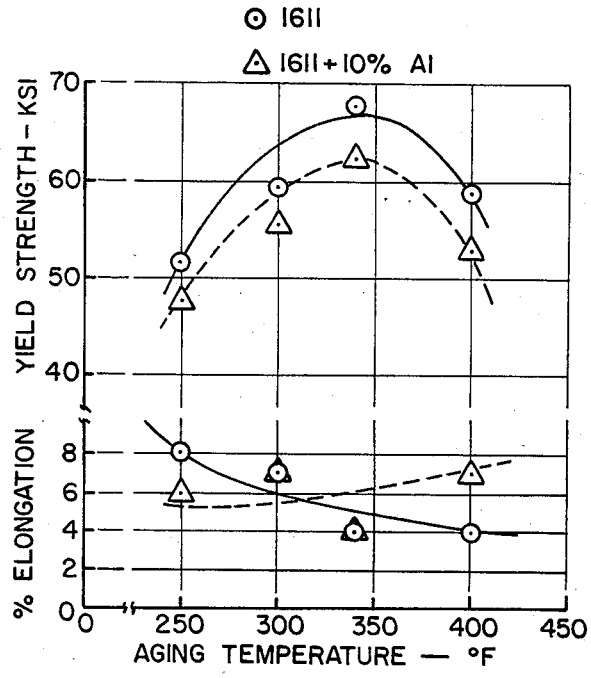
FIG. 3 is a plot of transverse tensile properties as a function of aging temperature for the embodiment of FIG. 1.

Table 1.2 lists yield strengths and elongations measured in the transverse direction for the same aging temperatures. Samples from two different locations were taken for each aging temperature, as shown in the table. Averages for each pair are shown graphically in FIG. 3.

TABLE 1.2

TRANSVERSE TENSILE PROPERTIES

| Aging Temp. (°F.) | Aging Time (h) | 0.2 Yield Strength (ksi) 1611 | 0.2 Yield Strength (ksi) 1611 + 10% Al | Elongation (%) 1611 | Elongation (%) 1611 + 10% Al |
|---|---|---|---|---|---|
| 250 | 16 | 51.5 | 48.3 | 8 | 6 |
| | | 51.5 | 47.3 | 8 | 6 |
| 300 | 40 | 59.5 | 55.5 | 8 | 8 |
| | | 59.4 | 55.7 | 6 | 6 |
| 340 | 100 | 67.5 | 62.2 | 4 | 4 |

TABLE 1.2-continued

| TRANSVERSE TENSILE PROPERTIES | | | | | |
|---|---|---|---|---|---|
| Aging Temp. (°F.) | Aging Time (h) | 0.2 Yield Strength (ksi) 1611 | 0.2 Yield Strength (ksi) 1611 + 10% Al | Elongation (%) 1611 | Elongation (%) 1611 + 10% Al |
| | | 67.7 | 62.7 | 4 | 4 |
| 400 | 16 | 58.5 | 53.4 | 4 | 6 |
| | | 59.2 | 52.6 | 4 | 8 |

Once again, a loss of yield strength is observed while elongation is generally unchanged.

Figure 4:
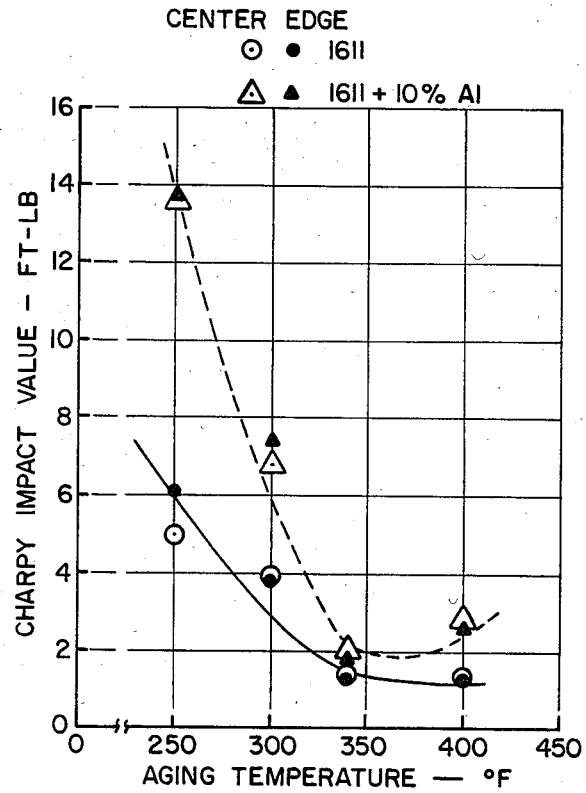
FIG. 4 is a plot of Charpy impact values as a function of aging temperature for the embodiment of FIG. 1.

Impact values were determined in the longitudinal direction by Charpy impact tests, using 10 mm square, V-notched specimens at ambient temperature, the notches running transverse to the direction of extrusion. Multiple specimens from both the center and edge of the extruded samples at the extrusion edge were tested. The results are shown in Table 1.3. Averaged values are shown graphically in FIG. 4, where the 300° F. values are for 16 h aging time.

TABLE 1.3

| IMPACT VALUES | | | | | |
|---|---|---|---|---|---|
| Aging Temp. (°F.) | Aging Time (h) | Longitudinal Impact Values (ft-lbs) Center Samples 1611 | Center Samples 1611 + 10% Al | Edge Samples 1611 | Edge Samples 1611 + 10% Al |
| 250 | 16 | 5.0 | 10.9 | 6.3 | 12.7 |
| | | | | 5.7 | 14.7 |
| | | — | 16.3 | 6.1 | 13.6 |
| | | | | 6.2 | 13.9 |
| 300 | 16 | 3.7 | 6.3 | 3.4 | 6.9 |
| | | | | 4.6 | 8.3 |
| | | 4.2 | 7.3 | 3.5 | 7.4 |
| | | | | 3.7 | 7.2 |
| 300 | 40 | 4.1 | 3.6 | 5.0 | 6.4 |
| | | 2.6 | 3.7 | 3.3 | 6.3 |
| 340 | 100 | 1.3 | 1.9 | 1.3 | 1.9 |
| | | | | 1.3 | 1.6 |
| | | 1.4 | 2.1 | 1.3 | 1.9 |
| | | | | 1.2 | 1.8 |
| 400 | 16 | 1.2 | 2.4 | 1.4 | 2.3 |
| | | | | 1.2 | 2.6 |
| | | 1.6 | 3.3 | 1.2 | 2.7 |
| | | | | 1.3 | 2.7 |

It is clear from these figures that the impact toughness is consistently higher in the samples containing the added unalloyed aluminum.

Figure 5:
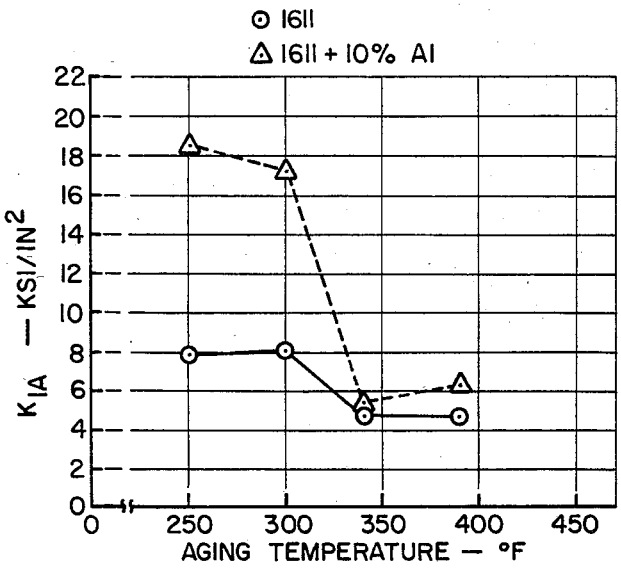
FIG. 5 is a plot of fracture toughness as a function of aging temperature for the embodiment of FIG. 1.

Fracture toughness values ($K_{1A}$) in the short transverse direction were provided by the stress intensity factor measured by applying tension in the short transverse direction at right angles to a machined notch extending into the sample in the extrusion direction. The extrusions used were 0.5 inch (1.3 cm) thick and 1.5 inch (3.8 cm) wide. The stress intensity results at the various aging temperatures (three trials each) are shown in Table 1.4, and the averages depicted graphically in FIG. 5.

TABLE 1.4

| FRACTURE TOUGHNESS - SHORT TRANSVERSE DIRECTION | | | |
|---|---|---|---|
| Aging Temp. (°F.) | Aging Time (h) | Stress Intensity $K_{1A}$ (ksi-in$^{\frac{1}{2}}$) 1611 | Stress Intensity $K_{1A}$ (ksi-in$^{\frac{1}{2}}$) 1611 + 10% Al |
| 250 | 16 | 8.4 | 18.9 |
| | | 7.7 | 16.6 |
| | | 7.6 | 20.0 |
| 300 | 16 | 9.9 | 17.3 |
| | | 7.0 | 17.6 |
| | | 7.3 | 16.9 |
| 340 | 16 | 5.1 | 5.7 |

TABLE 1.4-continued

| FRACTURE TOUGHNESS - SHORT TRANSVERSE DIRECTION | | | |
|---|---|---|---|
| Aging Temp. (°F.) | Aging Time (h) | Stress Intensity $K_{1A}$ (ksi-in$^{\frac{1}{2}}$) 1611 | Stress Intensity $K_{1A}$ (ksi-in$^{\frac{1}{2}}$) 1611 + 10% Al |
| | | 4.6 | 5.5 |
| | | 4.7 | 5.4 |
| 390 | 16 | 5.1 | 6.6 |
| | | 4.9 | 6.1 |
| | | 4.2 | 6.2 |

The samples containing the added unalloyed aluminum are consistently superior.

Stress corrosion cracking thresholds were determined in the same manner, except that the specimens were subjected to controlled drips of 3.5% aqueous sodium chloride solution during the test, which lasted three weeks. The thresholds at various aging temperatures are shown in Table 1.5.

TABLE 1.5

| STRESS CORROSION CRACKING THRESHOLD | | | |
|---|---|---|---|
| Aging Temp. (°F.) | Aging Time (h) | S.C.C. Threshold (ksi-in$^{\frac{1}{2}}$) 1611 | S.C.C. Threshold (ksi-in$^{\frac{1}{2}}$) 1611 + 10% Al |
| 250 | 16 | 7.2 | 10.4 |
| | | 7.6 | 11.8 |
| | | 7.6 | |
| 300 | 16 | 8.0 | 9.6 |
| | | 5.6 | 12.1 |
| | | 6.3 | 12.2 |

Again, the results for the samples containing the added unalloyed aluminum are consistently higher.

Figure 6:
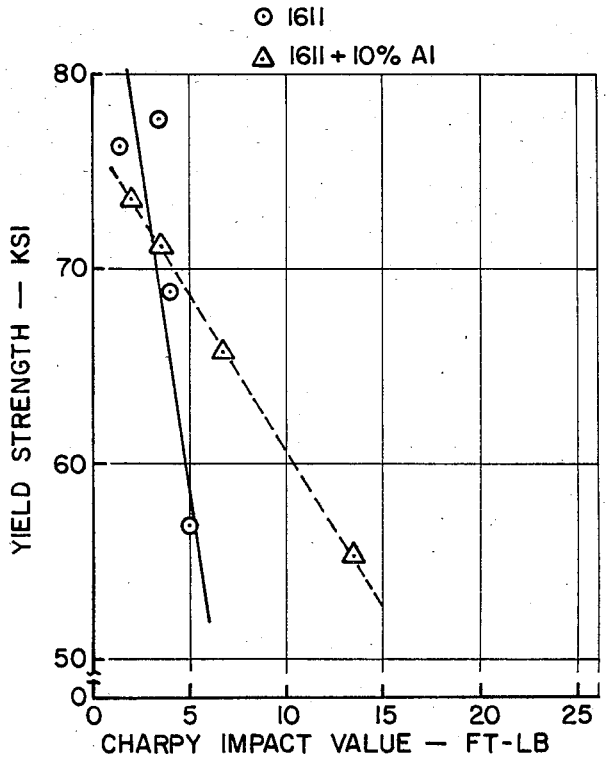
FIG. 6 is a plot of yield strength vs. impact toughness for specimens taken from the center of an extrusion of the embodiment of FIG. 1.
Figure 7:
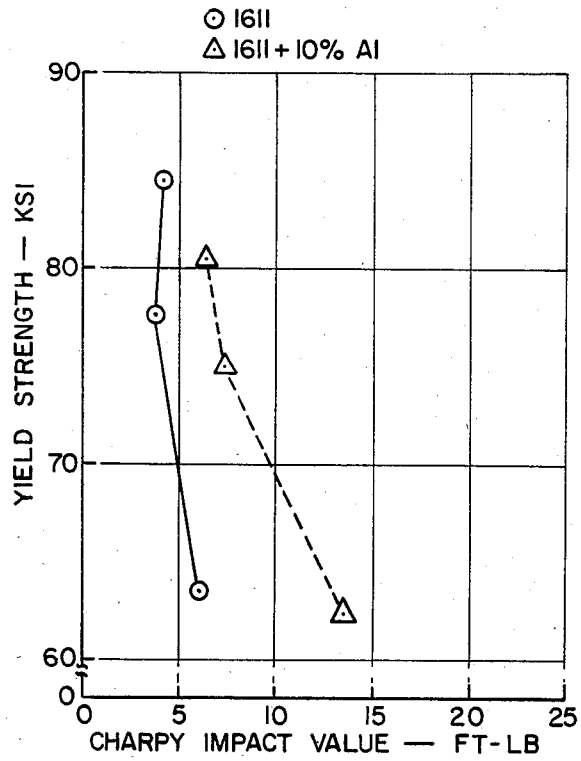
FIG. 7 is a plot similar to FIG. 6 except that the plotted values relate to edge specimens.

While the data above indicate an increase in toughness at the expense of strength, FIGS. 6 and 7 demonstrate that the overall result, i.e., the combination of strength and toughness at both center and edge of the extrusion, measured longitudinally, is superior for the product containing the added unalloyed aluminum. The values for the points in these graphs are given in Tables 1.6 and 1.7, each of which cover a range of aging conditions in terms of both temperature and time. The ranges extend from mild conditions through optimum conditions (resulting in peak properties) and beyond into overaging with detrimental effects. Since overaging is both detrimental and wasteful of both energy and processing time, the results plotted for comparison in the figures are those corresponding to aging conditions increasing to and including the optimum but not beyond. In FIG. 6 and Table 1.6, the optimum is generally between 300° F. at 40 hours and 340° F. at 100 hours, whereas in FIG. 7 and Table 1.7, the optimum is 300° F. at 40 hours. The figures show a general improvement in the combination of strength and toughness for both center and edge up to these conditions, for the product containing the unalloyed aluminum.

TABLE 1.6

| COMBINATION OF YIELD STRENGTH AND IMPACT VALUES - CENTER SPECIMENS | | | | | |
|---|---|---|---|---|---|
| Aging Temp. (°F.) | Aging Time (h) | 0.2 Yield Strength (ksi) 1611 | 0.2 Yield Strength (ksi) 1611 + 10% Al | Impact Value (ft-lb) 1611 | Impact Value (ft-lb) 1611 + 10% Al |
| 250 | 16 | 56.9 | 55.3 | 5.0 | 10.9 |
| | | | | | 16.3 |
| 300 | 16 | 69.1 | 65.9 | 3.7 | 6.3 |
| | | | | 4.2 | 7.3 |
| 300 | 40 | 78.2 | 72.6 | 4.1 | 3.6 |

TABLE 1.6-continued

| COMBINATION OF YIELD STRENGTH AND IMPACT VALUES - CENTER SPECIMENS | | | | | |
|---|---|---|---|---|---|
| Aging Temp. | Aging Time | 0.2 Yield Strength (ksi) | | Impact Value (ft-lb) | |
| (°F.) | (h) | 1611 | 1611 + 10% Al | 1611 | 1611 + 10% Al |
| | | 77.9 | 70.2 | 2.6 | 3.7 |
| 340 | 100 | 76.6 | 73.8 | 1.3 | 1.9 |
| | | | | 1.4 | 2.1 |
| 400 | 16 | 64.2 | 58.4 | 1.2 | 2.4 |
| | | | | 1.6 | 3.3 |

TABLE 1.7

| COMBINATION OF YIELD STRENGTH AND IMPACT VALUES - EDGE SPECIMENS | | | | | |
|---|---|---|---|---|---|
| Aging Temp. | Aging Time | 0.2 Yield Strength (ksi) | | Impact Value (ft-lb) | |
| (°F.) | (h) | 1611 | 1611 + 10% Al | 1611 | 1611 + 10% Al |
| 250 | 16 | 63.2 | 62.2 | 6.3 | 12.7 |
| | | | | 5.7 | 14.7 |
| | | 63.9 | 62.6 | 6.1 | 13.6 |
| | | | | 6.2 | 13.9 |
| 300 | 16 | 78.0 | 75.4 | 3.4 | 6.9 |
| | | | | 4.6 | 8.3 |
| | | 77.8 | 75.0 | 3.5 | 7.4 |
| | | | | 3.7 | 7.2 |
| 300 | 40 | 84.0 | 81.0 | 5.0 | 6.4 |
| | | 85.7 | 80.4 | 3.3 | 6.3 |
| 340 | 100 | 78.3 | 73.7 | 1.3 | 1.9 |
| | | | | 1.3 | 1.6 |
| | | 79.2 | 70.5 | 1.3 | 1.9 |
| | | | | 1.2 | 1.8 |
| 400 | 16 | 64.7 | 59.4 | 1.4 | 2.3 |
| | | | | 1.2 | 2.6 |
| | | 63.2 | 59.5 | 1.2 | 2.7 |
| | | | | 1.3 | 2.7 |

EXAMPLE 2

A composite product was prepared according to the procedure of Example 1, using, however, an aluminum-lithium alloy containing 3.49% Li, 1.25% Cu, 0.74% Mg and 0.12% Zr (designated herein as 1614).

Figure 8:
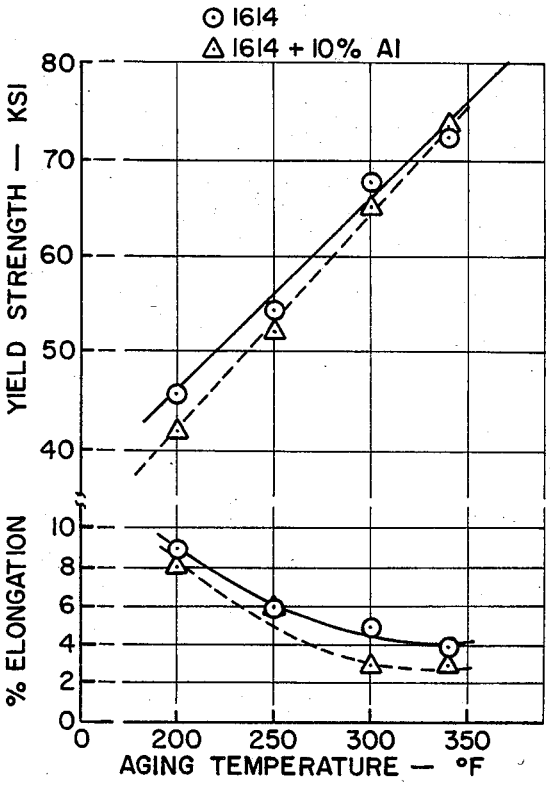
FIG. 8 is a plot similar to FIG. 1 for a second embodiment of the present invention, the data taken on center specimens.

The test procedures of Example 1 were applied. Tensile properties measured in the longitudinal direction at the center of the extrusion for different aging temperatures are listed in Table 2.1 below and shown graphically in FIG. 8.

TABLE 2.1

| LONGITUDINAL CENTER TENSILE PROPERTIES | | | | | |
|---|---|---|---|---|---|
| Aging Temp. | Aging Time | 0.2 Yield Strength (ksi) | | Elongation (%) | |
| (°F.) | (h) | 1614 | 1614 + 10% Al | 1614 | 1614 + 10% Al |
| 200 | 16 | 45.9 | 42.1 | 9 | 8 |
| 250 | 16 | 54.5 | 52.3 | 6 | 6 |
| 300 | 16 | 67.5 | 64.9 | 5 | 3 |
| 340 | 100 | 72.1 | 73.5 | 4 | 3 |

Figure 9:
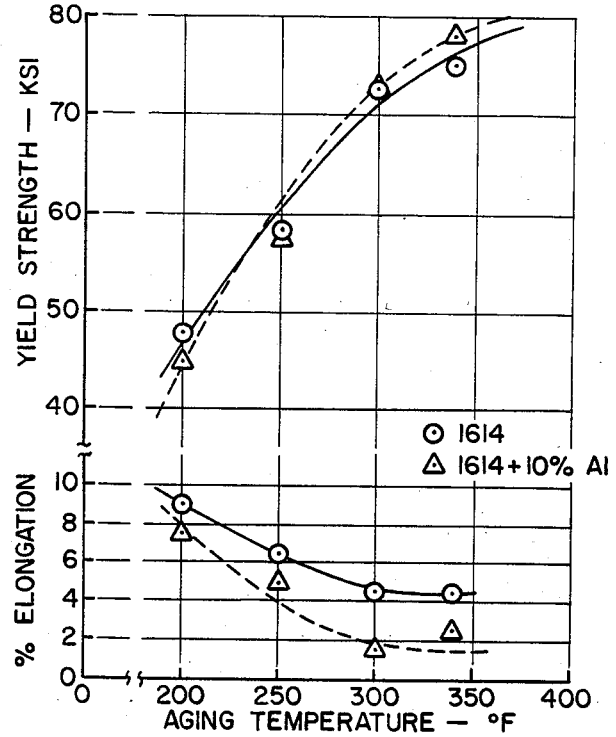
FIG. 9 is a plot of longitudinal tensile properties on edge specimens vs. aging temperature for the embodiment of FIG. 8.

Tensile properties measured in the longitudinal direction at the side edge of the extrusion are listed in Table 2.2 and the averages shown graphically in FIG. 9.

TABLE 2.2

| LONGITUDINAL EDGE TENSILE PROPERTIES | | | | | |
|---|---|---|---|---|---|
| Aging Temp. | Aging Time | 0.2 Yield Strength (ksi) | | Elongation (%) | |
| (°F.) | (h) | 1614 | 1614 + 10% Al | 1614 | 1614 + 10% Al |
| 200 | 16 | 47.9 | 44.7 | 9 | 8 |
| | | 47.4 | 44.7 | 9 | 7 |
| 250 | 16 | 57.9 | 57.4 | 7 | 5 |
| | | 58.4 | 57.2 | 6 | 5 |

TABLE 2.2-continued

| LONGITUDINAL EDGE TENSILE PROPERTIES | | | | | |
|---|---|---|---|---|---|
| Aging Temp. | Aging Time | 0.2 Yield Strength (ksi) | | Elongation (%) | |
| (°F.) | (h) | 1614 | 1614 + 10% Al | 1614 | 1614 + 10% Al |
| 300 | 16 | 72.4 | 73.4 | 4 | 1 |
| | | 72.8 | 73.6 | 5 | 2 |
| 340 | 100 | 75.2 | 78.0 | 4 | 2 |
| | | 75.4 | 78.1 | 5 | 3 |

Figure 10:
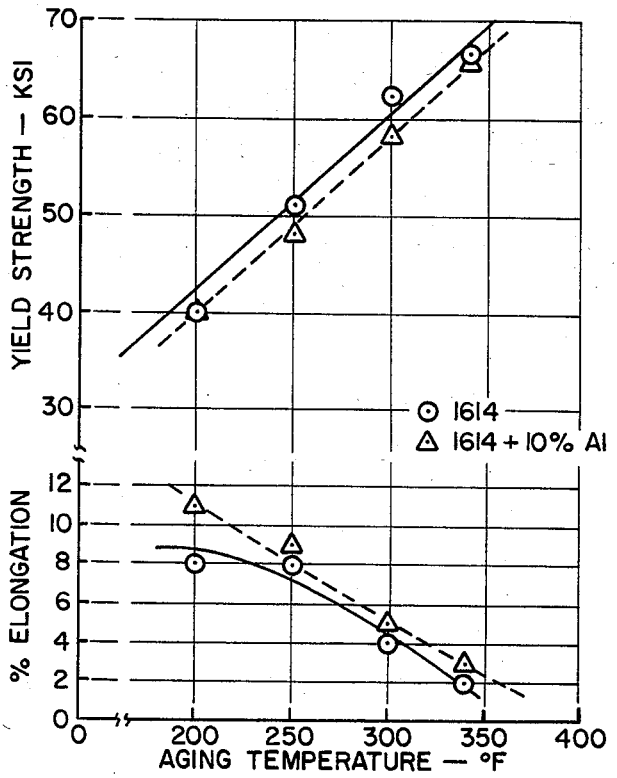
FIG. 10 is a plot of transverse tensile properties vs. aging temperature for the embodiment of FIG. 8.

Tensile properties measured in the transverse direction are listed in Table 2.3 and the averages shown graphically in FIG. 10.

TABLE 2.3

| TRANSVERSE TENSILE PROPERTIES | | | | | |
|---|---|---|---|---|---|
| Aging Temp. | Aging Time | 0.2 Yield Strength (ksi) | | Elongation (%) | |
| (°F.) | (h) | 1614 | 1614 + 10% Al | 1614 | 1614 + 10% Al |
| 200 | 16 | 38.6 | 41.5 | 6 | 12 |
| | | 41.4 | 38.7 | 10 | 10 |
| 250 | 16 | 51.0 | 48.0 | 8 | 10 |
| | | 51.2 | 48.1 | 8 | 8 |
| 300 | 16 | 62.6 | 58.1 | 4 | 4 |
| | | 62.0 | 58.2 | 4 | 6 |
| 340 | 100 | 66.9 | 65.5 | 2 | 2 |
| | | 66.8 | 66.0 | 2 | 4 |

Figure 11:
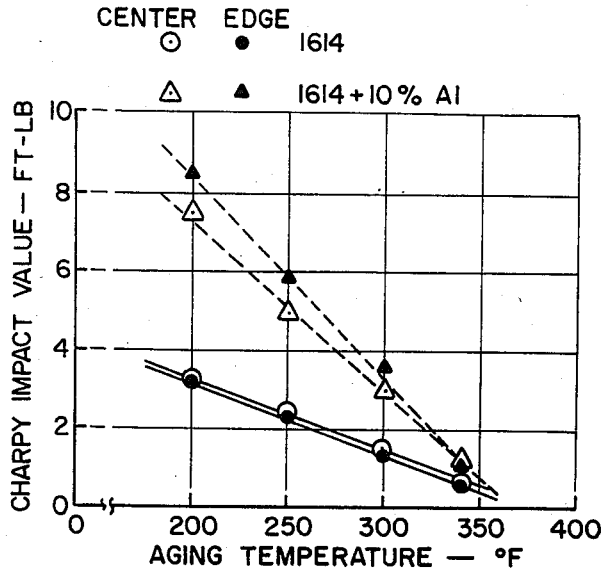
FIG. 11 is a plot of Charpy impact values vs. aging temperature for the embodiment of FIG. 8.

Charpy impact test results, following again the procedure of Example 1, are listed in Table 2.4 and the averages shown graphically in FIG. 11.

TABLE 2.4

| IMPACT VALUES | | | | | |
|---|---|---|---|---|---|
| Aging Temp. | Aging Time | Impact Values (foot-pounds) | | | |
| | | Center Samples | | Edge Samples | |
| (°F.) | (h) | 1614 | 1614 + 10% Al | 1614 | 1614 + 10% Al |
| 200 | 16 | 3.3 | 7.5 | 2.9 | 9.1 |
| | | | | 3.1 | 9.1 |
| | | | | 3.5 | 7.4 |
| 250 | 16 | 2.4 | 4.9 | 2.3 | 6.8 |
| | | | | 2.2 | 5.8 |
| | | | | 2.3 | 5.1 |
| 300 | 16 | 1.5 | 3.0 | 1.2 | 4.2 |
| | | | | 1.4 | 3.6 |
| | | | | 1.4 | 2.9 |
| 340 | 100 | 0.64 | 1.2 | 0.52 | 1.2 |
| | | | | 0.58 | 1.1 |
| | | | | 0.61 | 1.1 |

Figure 12:
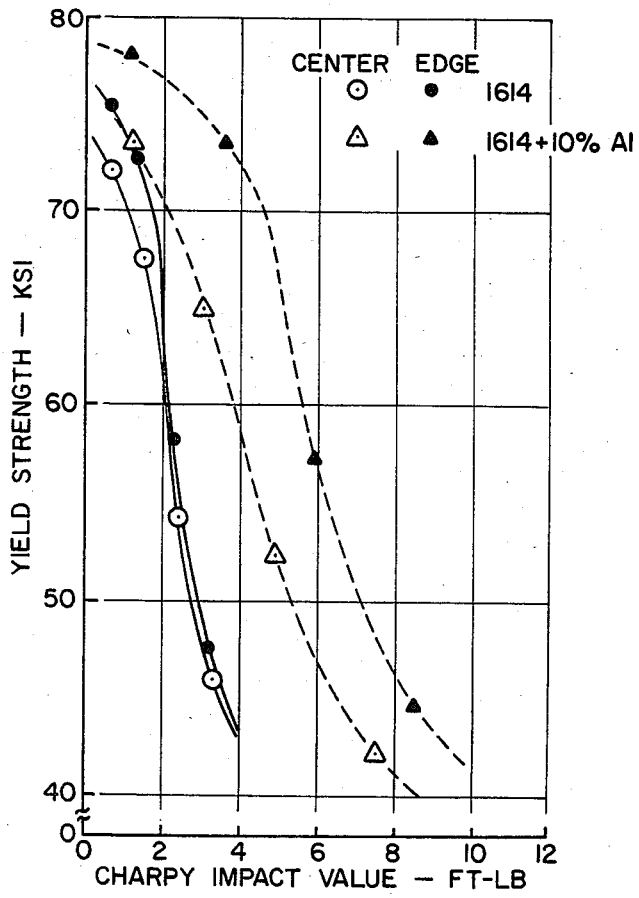
FIG. 12 is a plot of yield strength vs. impact toughness for the embodiment of FIG. 8.

Collectively, the data in these tables and figures indicate a consistent large improvement in toughness in the samples containing the added unalloyed aluminum, with only a small decrease in strength, and in some cases, no decrease at all. That the overall result is an improvement is confirmed by FIG. 12, which is a plot of data taken from Tables 2.1, 2.2 and 2.4.

Figure 13:
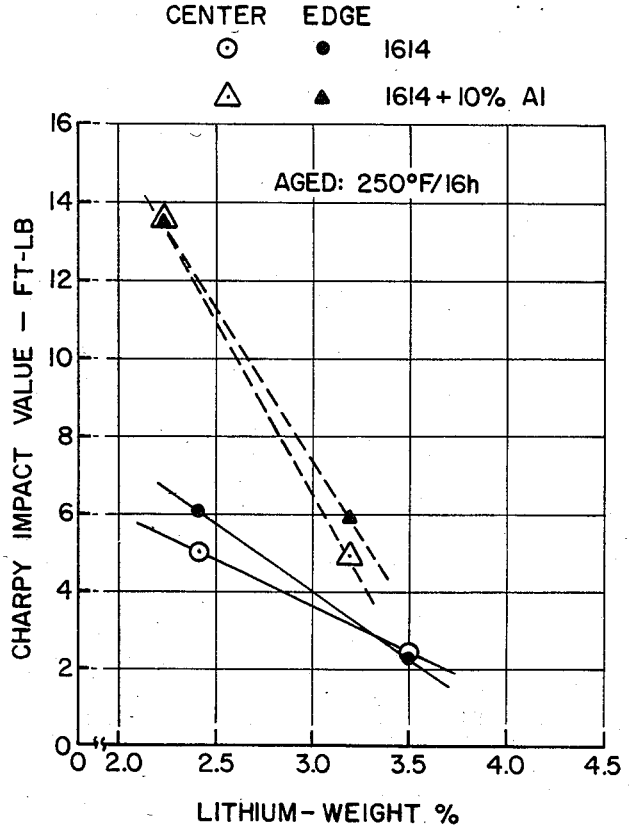
FIG. 13 is a plot of Charpy impact values vs. percent lithium taken from the values in the preceding figures for both embodiments.

To demonstrate that the toughness increase in these alloys is not simply a result of the decreased lithium content when unalloyed aluminum is added, the Charpy impact values are plotted as a function of lithium content in FIG. 13 for the four alloys covered by Examples 1 and 2. These values all represent the data from aging at 250° F. for 16 hours. While toughness does decrease with increase lithium content, the plot demonstrates that at the same lithium level, the products containing the added unalloyed aluminum are tougher than those composed of the straight alloys. This is evidenced by the vertical distance between the dashed and solid lines. Similarly, a given lithium content in a composite product containing added unalloyed aluminum produces the same toughness as a straight alloy with a higher lithium content—compare alloy 1611 with the composite of alloy 1614 and 10% added aluminum (horizontal distance between dashed and solid lines). Plots of the data for the other aging temperatures show the same types of differences.

The foregoing description is offered for illustrative purposes only. Numerous modifications and variations of the procedures and materials described above, while still falling within the spirit and scope of the invention, will be readily apparent to those skilled in the art.

What is claimed is:

1. An aluminum-based metallic product comprised of a first aluminum-based metal having a yield strength of at least about 30 ksi, having dispersed therein particles of a second aluminum-based metal having an impact toughness of at least about 20 foot-pounds.

2. An aluminum-based metallic product in accordance with claim 1 in which said second aluminum-based metal is at least about 99.5% pure aluminum.

3. An aluminum-based metallic product in accordance with claim 1 in which said first aluminum-based metal is an alloy containing a member selected from the group consisting of lithium, copper, zinc and magnesium as a primary alloying element.

4. An aluminum-based metallic product in accordance with claim 1 in which said first aluminum-based metal is an alloy containing lithium as a primary alloying element.

5. An aluminum-based metallic product in accordance with claim 1 in which said second aluminum-based metal comprises from about 2% to about 40% by weight of said product.

6. An aluminum-based metallic product in accordance with claim 1 in which said second aluminum-based metal comprises from about 5% to about 25% by weight of said product.

7. An aluminum-based metallic product in accordance with calim 1 in which said first aluminum-based metal is an alloy containing at least about 2% lithium by weight, and said second aluminum-based metal is at least about 99.5% pure aluminum.

8. An aluminum-based metallic product in accordance with claim 1 in which said particles are each about 0.0001 to about 0.01 cubic centimeters in volume.

9. An aluminum-based metallic product in accordance with claim 1 in which the yield strength of said first aluminum-based metal is at least about 50 ksi.

10. An aluminum-based metallic product in accordance with claim 1 in which the impact toughness of said second aluminum-based metal is at least about 50 foot-pounds.

11. An aluminum-based metallic product comprised of an aluminum alloy containing at least about 2% lithium by weight, and having dispersed therein particles of at least about 99.5% pure aluminum, said particles each having a volume of about 0.0001 to about 0.01 cubic centimeters and collectively comprising from about 2% to about 25% by weight of said product.

12. A method for preparing an aluminum-based metallic product, comprising:

(a) blending a first powered aluminum-based metal having a yield strength of at least about 30 ksi with a second powdered aluminum-based metal having an impact toughness of at least about 20 foot-pounds to form a substantially uniform powder mixture; and (b) consolidating said powder mixture into a billet.

13. A method in accordance with claim 12 in which said first and second powdered aluminum-based metals each have particle sizes ranging from about 10 to about 1000 microns in diameter.

14. A method in accordance with claim 12 in which said first and second powdered aluminum-based metals each have particles sizes ranging from about 50 to about 500 microns in diameter.

15. A method in accordance with claim 12 in which said second powdered aluminum-based metal is at least about 99.5% pure aluminum.

16. A method in accordance with claim 12 in which said first powdered aluminum-based metal is an alloy containing a member selected from the group consisting of lithium, copper, zinc and magnesium as a primary alloying element.

17. A method in accordance with claim 12 in which said first powdered aluminum-based metal is an alloy containing at least about 2% lithium by weight, and said second powdered aluminum-based metal is at least about 99.5% pure aluminum.

18. A method in accordance with claim 12 in which said second powdered aluminum-based metal comprises from about 2% to about 40% by weight of said product.

19. A method in accordance with claim 12 in which said second powdered aluminum-based metal comprises from about 5% to about 25% by weight of said product.

20. A method in accordance with claim 12 in which the yield strength of said first powdered aluminum-based metal is at least about 50 ksi.

21. A method in accordance with claim 12 in which the impact toughness of said second powdered aluminum-based metal is at least about 50 foot-pounds.

22. A method in accordance with claim 12 further comprising removing substantially all bound water from the surface of the particles in said powder mixture.

23. A method in accordance with claim 12 further comprising purging said powder mixture with an inert gas to remove substantially all bound water from the surface of said particles.

24. A method in accordance with claim 12 in which step (b) comprises compacting said powder mixture to at least about 85% full density.

25. A method in accordance with claim 12 in which step (b) comprises compacting said powder mixture to at least about 95% full density.

26. A method for preparing an aluminum-based metallic product, comprising:

(a) blending a powdered aluminum-based alloy containing at least about 2% lithium by weight and having a particle size of about 10 to about 1000 microns in diameter, with powdered aluminum which is at least about 99.5% pure and has a particle size of about 10 to about 1000 microns to form a substantially uniform powder mixture of which said powdered aluminum comprises from about 5% to about 25% by weight; and (b) consolidating said powder mixture into a billet.

* * * * *